US005186562A

United States Patent [19]

Yoshinaga et al.

[11] Patent Number: 5,186,562

[45] Date of Patent: Feb. 16, 1993

[54] ELONGATE HANDWRITING IMPLEMENT WITH ROTATABLE DECORATION ON REAR END

[75] Inventors: Shigeo Yoshinaga; Tatsuo Ikegami; Seiji Osaki, all of Tokyo, Japan

[73] Assignee: Yoshinaga Corporation, Tokyo, Japan

[21] Appl. No.: 891,231

[22] Filed: May 29, 1992

[30] Foreign Application Priority Data

Jan. 23, 1992 [JP] Japan ..... 4-006552[U]

[51] Int. Cl.[5] ..... B43K 29/00

[52] U.S. Cl. ..... 401/112; 401/195

[58] Field of Search ..... 401/195, 52, 109-114, 401/116; 446/236, 241, 266

[56] References Cited

U.S. PATENT DOCUMENTS 3,865,496 2/1975 Robbins ..... 401/112 X
3,985,455 10/1976 Wahlberg ..... 401/112 X
4,755,074 7/1988 Roberts ..... 401/52
5,083,881 1/1992 Yoshinaga ..... 401/195

FOREIGN PATENT DOCUMENTS 2339816 2/1973 Fed. Rep. of Germany ..... 401/52
2307791 9/1973 Fed. Rep. of Germany ..... 401/52

*Primary Examiner*—Danton D. DeMille
*Attorney, Agent, or Firm*—Weingarten, Schurgin, Gagnebin & Hayes

[57] ABSTRACT

An elongate handwriting implement with a rotatable decoration on the rear end is disclosed. The rear end of an elongate handwriting casing has the decoration. The decoration includes a tubular fixed element fitting around the rear end of the handwriting casing and a hollow rotatable decoration body. The cylindrical surface of the rear end of the fixed element has a plurality of outwardly radially extending camming pins. The front end of the decoration body is open. The interior surface of the decoration body has an annular cam follower defining a plurality of follower grooves engaging the camming pins. The front ends of the follower grooves are open. The decoration body is rotatably and axially movably mounted to the fixed element in such a manner that the camming pins can be in and out of engagement with the follower grooves. The decoration body is rotatably connected to a handle assembly for a writing core through a decoration core extending in the axis of and within the fixed element.

3 Claims, 3 Drawing Sheets

ELONGATE HANDWRITING IMPLEMENT WITH ROTATABLE DECORATION ON REAR END

BACKGROUND OF THE INVENTION

1. Field of the Invention

The present invention relates to elongate handwriting implements, such as a knocked ballpoint pen and a knocked propelling pencil, having decorations provided on rear ends of the handwriting implements and rotatable in synchronization with knockings.

2. Description of the Related Art

Japanese unexamined utility model application publication HEI. 3-116993 discloses an elongate handwriting implement having a decoration provided on the rear end and movable in synchronization with knockings.

This prior-art handwriting implement comprises a decoration in which a fixed element is provided on the rear end of the elongate handwriting implement and has a predetermined number of openable and closable petals integrally formed thereto and a movable element resembles calyces and is connected to a handle provided in an elongate tubular handwriting casing by means of a decoration core. A person moves the movable element along the axis of the handwriting implement by means of the handle to open and close the petals.

This handwriting implement provides an amusement of opening and closing the petals in synchronization with knocking of the writing point. However, the handle can only produce the axial movement of opening and closing the petals but no other movement of the decoration, e.g., a rotation.

The present invention was made in order to overcome the drawback in the prior-art handwriting implement with the decoration on the rear end. An object of the present invention is to provide a novel handwriting implement converting an axial movement of a handle for projecting and withdrawing the writing point to a rotation of a decoration provided on the implement by means of a cam assembly of camming pins and oblique follower grooves, thus enhancing a toying property of the handwriting implement.

SUMMARY OF THE INVENTION

In order to achieve the object, and elongate handwriting implement with a decoration on the rear end comprises: an elongated tubular handwriting casing an upper portion of which defines an engagement opening and a slot extending axially of the handwriting casing; a writing core mounted within the handwriting casing, the writing core being movable axially of the handwriting casing; a reset spring mounted within the handwriting casing and withdrawing the writing point of the writing core into the front end of the handwriting casing; a handle assembly, fixed to the rear end of the writing core and including an elongate elastic handle extending axially of the handwriting casing, for moving said writing core axially of the handwriting casing, the handle having an engagement projection in and out of engagement with the engagement opening and the slot; a support fixed to the rear end of the handle assembly; a decoration extending between the support and the rear end of the handwriting casing; the decoration having a tubular fixed element fixed to the rear end of the handwriting casing, and a hollow rotatable decoration body mounted to the fixed element, the rotatable body being rotatable about and movable axially of the fixed element, the outer cylindrical surface of the fixed element having a plurality of outwardly radially extending camming pins, the interior surface of the decoration body having an annular rotatable cam follower the sidewall of which defines a plurality of follower grooves engaging the camming pins, the front end of each follower groove being open, the decoration body being connected to the handle assembly through the support so as to be rotatable about and relative to the support.

The decoration body may have an opening for fixing a predetermined character thereto. A predetermined character may be fixed to the rear end of the support.

When the reset spring pushes up the handle assembly and the writing core, i.e., the writing point is within the front end of the handwriting casing, the reset spring also currently pushes up the decoration body and the camming pins remove from the follower grooves to a lower portion of the interior of the decoration body.

Pushing the handle disengages the engagement projection from the engagement opening. Then, moving the handle assembly towards the front end of the handwriting casing to compress the reset spring and project the writing point from the front end of the handwriting casing moves the decoration body towards the front end of the handwriting casing while the fixed element guides the handle assembly and the decoration body. Finaly, the engagement projection faces and engages the rear edge of the slot. The movement of the handle assembly moves the camming pins to the rear edges of the follower grooves and rotates the decoration body. On the other hand, pushing the handle to disengage from the rear edge of the slot to withdraw the writing point into the front end of the handwriting casing causes the compressed reset spring to return the writing core and the handle assembly to their withdrawn positions.

The reset spring also return the decoration body to its normal position while camming pins move to the front edges of the follower grooves to rapidly spiral the decoration body. The decoration body continues rotating since the camming pins have removed from the cam follower so that the rotation of the decoration body is completely set free.

DESCRIPTION OF THE PREFERRED EMBODIMENTS

Preferred embodiments of the present invention will be described with reference to the drawings hereinafter.

Figure 1:
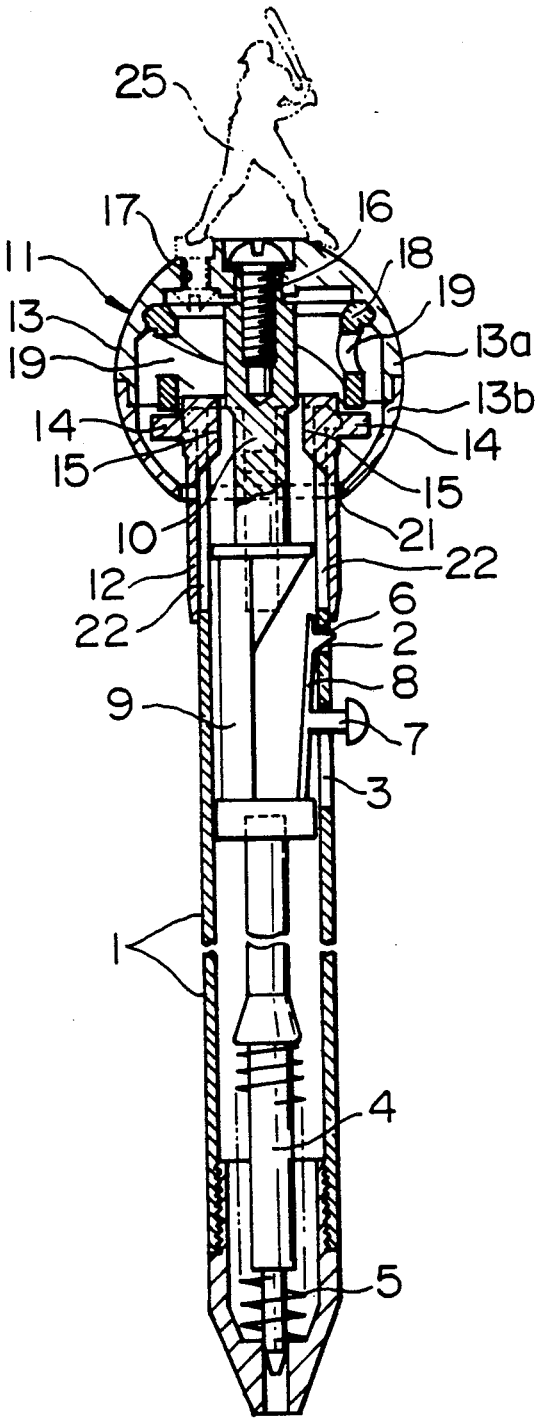
FIG. 1 is a longitudinal section through an elongate handwriting implement with a rotatable decoration on the rear end according to a first embodiment of the present invention, the writing point being in a position withdrawn within the front end of a tubular handwriting casing.
Figure 2:
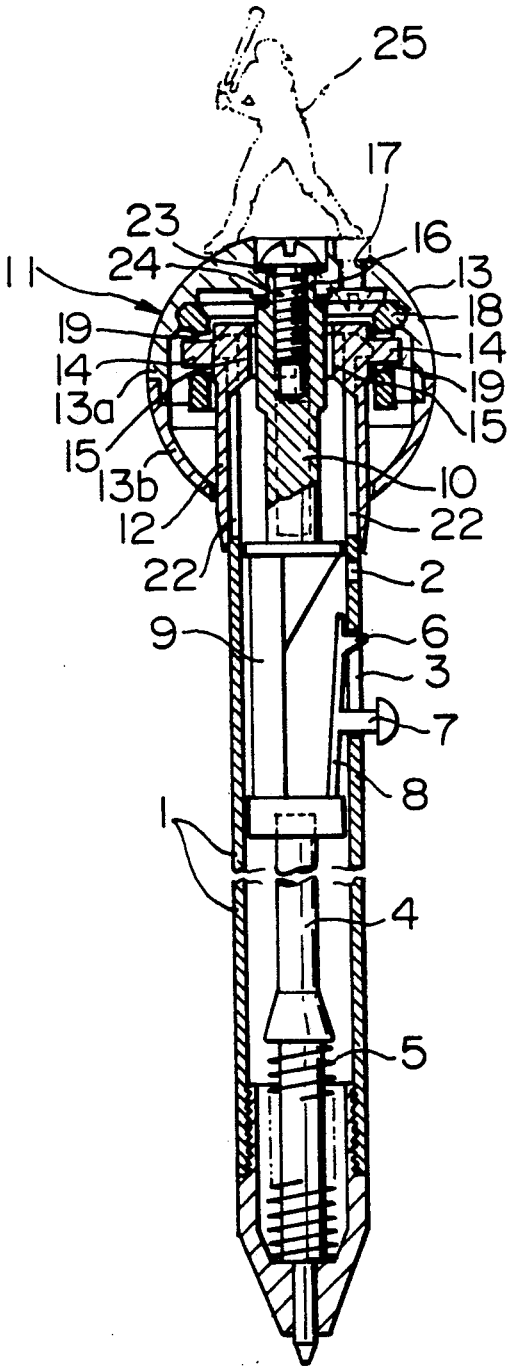
FIG. 2 is a longitudinal section through the elongate handwriting implement of FIG. 1, the writing point being in a position projecting from within the front end of the handwriting casing.

As shown in FIGS. 1 and 2, an elongate cylindrical handwriting casing 1 with a relatively large diameter has a tapered front end. An upper portion of the handwriting casing 1 defines an engagement opening 2 and a handling slot 3 extending along the axis of the handwriting casing 1 right below the engagement opening 2. The rear edge of the handwriting casing 1 is open.

The handwriting casing 1 contains an axially movable elongate ink magazine 4 for a ballpoint and a compression reset spring 5 mounted around a front side portion of the ink magazine 4. A handle assembly 9 made of elastic plastic is attached to the rear end of the ink magazine 4. A side of the front end of the handle assembly 9 has an elastic elongate handle 8 extending along the axis of the handwriting casing 1. A side surface of the handle 8 facing the interior surface of the handwriting casing 1 has an engagement projection 6 and a knob 7 provided below the engagement projection 6. The engagement projection 6 is engageable with the edge of the engagement opening 2 and the rear edge of the handling slot 3. The knob 7 engages the handling slot 3. A decoration core 10 which extends from and rearwards the rear end of the handling assembly 9 is molded integrally with the handling assembly 9.

A decoration 11 made of plastic is attached to the rear end of the handwriting casing 1. The decoration 11 comprises a tubular fixed element 12 fitting around the rear end of the handwriting casing 1 and a hollow spherical rotatable body 13 mounted around the fixed element 12. The outer cylindrical surface of the rear end of the fixed element 12 has a plurality of outwardly radially extending camming pins 14. The inner cylindrical surface of the rear end of the fixed element 12 has a predetermined number of fittings 15 extending along the axis of the fixed element 12.

Figure 3:
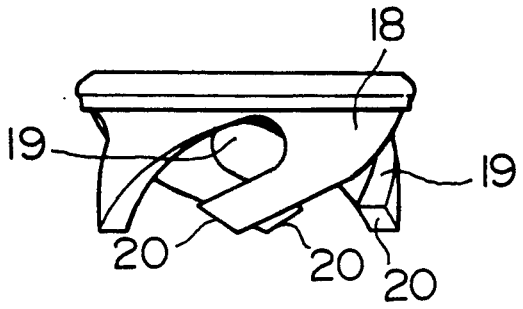
FIG. 3 is a side view of a rotatable cam follower of the handwriting implement of FIG. 1.

The decoration body 13 comprises a hollow upper hemispherical half 13*a* and a hollow lower hemispherical half 13*b*. The decoration core 10 extends in the axial direction of the handwriting 1 within the decoration 11. A central portion of the top of the upper hemispherical half 13*a* has a stepped through hole 16 through which the rear end of the decoration core 10 freely passes. The top of the upper hemispherical half 13*a* has a through hole 17 adjacent the stepped through hole 16 for fixing a character 25 in the form of a baseball batter to the upper hemispherical half 13*a*. Thus, the character 25 can rotate together with the decoration body 13 about and relative to the decoration core 10. The interior surface of the upper hemispherical half 13*a* has an essentially annular rotatable cam follower 18 integrally attached thereto. As best shown in FIG. 3, the side of the cam follower 18 defines oblique follower grooves 19 arranged equiangularly in the circumference of the cam follower 18 and engaging the camming pins 14. Each follower groove 19 extends in the same angular direction and has open front edge. A leading side of the front edge of the follower groove 19 has an oblique edge surface 20 ascending with the rotation of the decoration 13 so as to securely guide a camming pin 14 into the front edge of the follower groove 19. A central portion of the bottom of the lower hemispherical half 13*b* defines a circular opening 21 having a diameter larger than the outer diameter of the fixed element 12. The rear edge of the lower hemispherical half 13*b* is fitted into the front edge of the upper hemispherical half 13*a* to constitute the hollow rotatable decoration body 13 in such a manner that the rear end of the fixed element 12 previously passes into the lower hemispherical half 13*b* through the circular opening 21. Thus, the decoration body 13 is movable axially of and rotatable about the fixed element 12.

Thus, the decoration 11 comprising the decoration body 13 and the fixed element 12 is attached to the rear end of the handwriting casing 1 in such a manner that the fixed element 12 fits the rear end of the handwriting casing 1 and the decoration body 13 is mounted rotatably to the suppot 10. The fittings 15 of the fixed element 12 are inserted into axial grooves 22 defined in the rear end of the handwriting casing 1 to mount the fixed element 12 to the handwriting casing 1. The rear end of the decoration core 10 rotatably passes through the through hole 16. A screw 24 connects the decoration body 13 to the decoration core 10 through a washer 23 mounted on the rear edge of the through hole 16 so that the decoration body 13 is rotatable about and relative to the decoration core 10 and the screw 24 retains the axial position of the decoration body 13.

Figure 4:
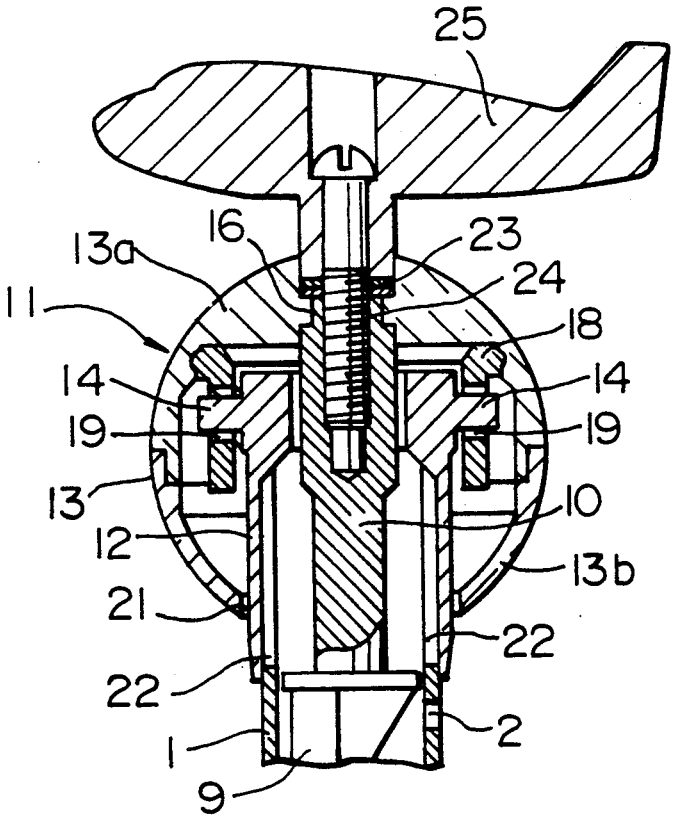
FIG. 4 is a longitudinal section through a main part of the decoration of an elongate handwriting implement with a rotatable decoration on the rear end according to a second embodiment of the present invention.

FIG. 4 is a longitudinal section of a joint of the decoration and a handwriting casing of an elongate handwriting implement with a rotatable decoration on the rear end according to a second embodiment of the present invention. The handwriting implement has a character 25 in the form of an air plane fixed to the rear end of the decoration core 10 by means of a washer 23 and a screw 24. The surface of a hollow rotatable decoration body 13 resembles the surface of a terrestrial globe in harmony with the character 25 although it is not shown.

In a state in which the writing point is in a position withdrawn within the front end of a handwriting casing 1 as similarly as in the first embodiment of the present invention shown in FIG. 1, a reset spring 5 retains a handle assembly 9 at the rear limit of movement of the handle assembly 9. The decoration body 13 also is at the rear limit of movement, so that the camming pins 14 are out of the follower grooves 19 within the lower hemispherical half 13*b* of the decoration body 13.

In this state, pushing the handle 8 by means of the knob 7 removes the engagement projection 6 from the engagement opening 2. Moving the handle assembly 9 by means of the knob 7 towards the front end of the handwriting casing 1 compresses the reset spring 5 and projects the writing point from the front end of the handwriting casing 1, so that the decoration body 13 moves towards the front end of the handwriting casing 1 along the fixed element 12. This movement advances the camming pins 14 to the closed rear ends of the follower grooves 19 to counterclockwise rotate the decoration body 13 through approximately 90 degrees when the decoration body 13 is viewed from the front end of the handwriting casing 1. The engagement projection 6 is moved to and faces the rear edge of the handling slot 3. Releasing the knob 7 causes the elastic handle 8 to engage the engagement projection 6 with the rear edge of the handling slot 3.

In this state, pushing the knob 7 removes the engagement projection 6 from the rear edge of the handling slot 3, so that the reset spring 5 rapidly returns the ink magazine 4 and the handle assembly 9 to their withdrawn positions to withdraw the writing point into the front end of the handwriting casing 1.

The decoration body 13 is concurrently rapidly returned to its withdrawn position and the camming pins 14 remove from within the follower grooves 19 to under the cam follower 18, so that the decoration body 13 rapidly spirals upwards. This sets the decoration of the decoration body 13 free, so that the decoration body 13 continues rotating by inertia.

The decoration attached to the rear end of the elongate handwriting casing is rotated when the writing point is projected from and withdrawn into the front end of the handwriting casing of the handwriting implement by means of the handle assembly, which amuses a user of the handwriting implement to provide the function of a toy in addition to the function of the handwriting implement. Since the decoration can be colored and the outer surface of the decoration can have an artistic design, the rotation of the decoration provides changes in color and artistic design when the writing point is projected from and withdrawn into the front end of the hand writing casing, which amuses the user of the handwriting implement. Since the decoration can have a character resembling a baseball batter or matched sumo wrestlers, the rotation of the decoration amuses the user of the handwriting implement. Since the character is fixed to the handle assembly by means of the decoration core and the rotatable decoration body is rotatable about the decoration core and the handle assembly, the character can provide a feeling as if it would rotate relative to the decoration body, which amuses the user of the handwriting implement. Since the cam assembly of the camming pins and follower grooves defining cam follower converts the axial movement of the handle assembly into the rotation of the decoration body, the structure of the decoration is relatively simple. Since the front end of each follower groove of the cam follower is open so that the camming pin can remove from a corresponding follower groove, the camming pins cannot interfere with the rotation of the decoration and the limited axial movement of the handle assembly can securely smoothly rotate the decoration body.

What is claimed is:

1. An elongate handwriting implement with a rotatable decoration on the rear end, comprising:

an elongate tubular handwriting casing an upper portion of which defines an engagement opening and a slot extending along the axis of said handwriting casing;

a writing core mounted within said handwriting casing, said writing core being movable axially of said handwriting casing;

a reset spring mounted within said handwriting casing and withdrawing the writing point of said writing core into the front end of said handwriting casing;

a handle assembly, fixed to the rear end of said writing core and including an elongate elastic handle extending along the axis of said handwriting casing, for moving said writing core axially of said handwriting casing, the handle having an engagement projection in and out of engagement with the opening and the slot;

a support fixed to the rear end of the handle assembly;

a decoration extending between said support and the rear end of the handwriting casing; and said decoration having a tubular fixed element fixed to the rear end of said handwriting casing, and a hollow rotatable decoration body mounted to the fixed element, the decoration body being rotatable about and movable axially of the fixed element, the outer cylindrical surface of the fixed element having a plurality of autwardly radially extending camming pins, the interior surface of the decoration body having an annular rotatable cam follower the sidewall of which defines a plurality of follower grooves engaging the camming pins, the front end of each follower groove being open, the decoration body being connected to said handle assembly through said support so as to be rotatable about and relative to said support.

2. The elongate handwriting implement as recited in claim 1, wherein the decoration body has an opening for fixing a predetermined character thereto.

3. The elongate handwriting implement as recited in claim 1, wherein a predetermined character is fixed to the rear end of said support.

* * * * *